United States Patent [19]

Hunter et al.

[11] Patent Number: 4,458,177

[45] Date of Patent: Jul. 3, 1984

[54] FLEXIBLE ELECTROLUMINESCENT LAMP DEVICE AND PHOSPHOR ADMIXTURE THEREFOR

[75] Inventors: James W. Hunter, Cleveland; Francois A. Lavallee, Cleveland Heights, both of Ohio

[73] Assignee: General Electric Company, Schenectady, N.Y.

[21] Appl. No.: 218,931

[22] Filed: Dec. 22, 1980

[51] Int. Cl.[3] ..... H01J 1/62; H01J 63/04

[52] U.S. Cl. ..... 313/511; 313/498; 313/503; 313/506; 252/301.4 P

[58] Field of Search ..... 313/502, 503, 511, 504, 313/498, 506; 427/66; 252/301.4 P

[56] References Cited

U.S. PATENT DOCUMENTS

| | | | |
|---|---|---|---|
| 2,857,541 | 10/1958 | Etzel et al. | 313/502 |
| 3,023,338 | 2/1962 | Cerulli | 313/502 |
| 3,047,052 | 7/1962 | Fridrich et al. | 156/580 |
| 3,286,115 | 11/1966 | Ranby et al. | 313/502 |
| 3,315,111 | 4/1967 | Jaffe et al. | 313/503 |
| 3,440,471 | 4/1969 | Baczewski et al. | 313/502 |
| 4,137,481 | 6/1979 | Hilsum et al. | 313/503 |
| 4,177,399 | 12/1979 | Muccigrosso et al. | 313/478 X |

*Primary Examiner*—Eugene R. LaRoche
*Assistant Examiner*—K. Wieder
*Attorney, Agent, or Firm*—John F. McDevitt; Philip L. Schlamp; Fred Jacob

[57] ABSTRACT

An improved phosphor admixture is provided for an electroluminescent cell or lamp which reduces the electric arc susceptibility during normal operation. Said phosphor admixture includes an electrically non-conductive, same color light-transmitting particulate solid as a means of reducing the current density of said electroluminescent cell during operation with a minimum brightness loss.

4 Claims, 1 Drawing Figure

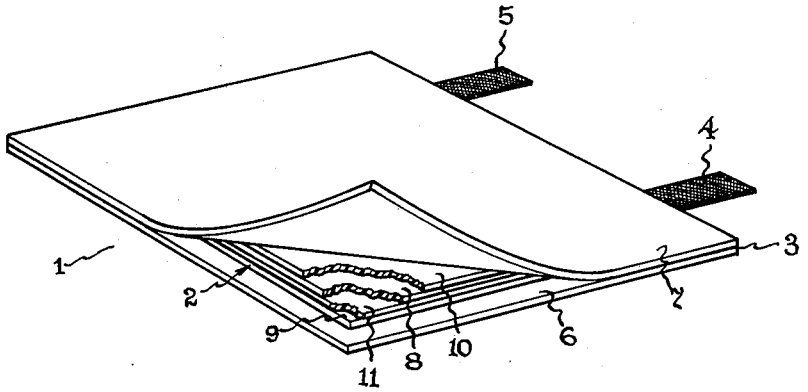
5
4
3
1
2
9
11
8
10
6
7

FLEXIBLE ELECTROLUMINESCENT LAMP DEVICE AND PHOSPHOR ADMIXTURE THEREFOR

BACKGROUND OF THE INVENTION

This invention relates, in general, to particular phosphor admixtures which provide improved operation of flexible electroluminescent cells or lamps. Detailed descriptions of such type lamp constructions are found in issued U.S. Pat. Nos. 3,315,111 and 3,047,052, both assigned to the same assignee as the present invention. These flexible electroluminescent cells or lamps have component elements of a flexible character generally comprising a layer of an electroluminescent or field-responsive phosphor sandwiched between a pair of electrically conductive or electrode layers at least one of which is light-transmitting. When an alternating current of sufficient potential is impressed between the electrode components, the phosphor material is excited to a luminescence and the resulting light is emitted through the light-transmitting electrode layer.

A serious problem still encountered in the operation of said type electroluminescent cells or lamps is the occurrence of one or more electrical arcs which can thermally destroy the organic materials ordinarily used in the cell construction. The arcing condition is understandably enhanced at higher current densities of cell operation with shortened life being experienced along with brightness loss since arcing can cause the subsequent destruction of the cell itself. As used herein, the term "current density" signifies the milliamperes of electrical current per square inch of the light-emitting layer surface area during cell operation while the term "brightness" signifies the light output of the cell measured in foot-lamberts. Lessening of this operational problem by a means which does not produce significant brightness loss is thereby an important objective. To achieve said objective in a manner which does not further require structural modification of the existing cell design would also prove beneficial.

SUMMARY OF THE INVENTION

It has now been discovered that incorporation of a particular additive in the electroluminescent phosphor material prevents the electrical arcing condition during ordinary cell operation, and it can be done without occasioning excessive brightness loss. More particularly, such improvement has been imparted with an admixture of a suitable electroluminescent phosphor in particle form with an electrically non-conductive and same color light-transmitting particulate solid in amounts sufficient to reduce the current density of electroluminescent cell operation. By "same color light-transmitting" additive is meant either a clear or colorless substance which does not absorb the light emitted by the phosphor or a substance that may absorb some phosphor emission but does not change the color of said phosphor emission to any significant extent.

Suitable additives for use in the above defined manner can be selected from numerous inorganic compounds which remain inert and electrically non-conductive in the phosphor layer and are already available in the finely divided solid form such as silica, alumina, and particles of the same phosphor material being employed in the phosphor admixture but which lack presence of the activator metal ion. The latter type admixtures are preferred as a means of lowering the electrical conductivity in the phosphor layer since the additive approximates the same optical transmission and physical size characteristics as the phosphor material being employed.

A particularly preferred phosphor admixture comprises in parts by weight about 60 parts to about 90 parts of electroluminescent phosphor particles admixed with about 40 parts to about 10 parts of unactivated phosphor particles having the same matrix composition and form. To illustrate a particularly preferred phosphor admixture in said category, there was employed approximately 60 parts by weight copper-activated zinc sulfide phosphor admixed with approximately 20 parts by weight of unactivated zinc sulfide which reduced the current density about 30% while light output was reduced less than 10% for an electroluminescent cell operated at 120 volts and 400 hertz input electrical power.

BRIEF DESCRIPTION OF THE DRAWING

The accompanying drawing depicts a flexible electroluminescent cell construction utilizing the present improvement which illustrates the internal construction of the cell unit.

DESCRIPTION OF THE PREFERRED EMBODIMENTS

Referring to the drawing, the electroluminescent cell or lamp 1 includes a flexible panel comprised of an inner electrically active cell portion or assembly 2 sealed within a substantially moisture-impervious outer encapsulating envelope 3. The cell 1, as illustrated, is of rectangular shape and may be energized by applying a suitable potential such as an alternating voltage, for example 120 volts at 60 hertz alternating current or higher frequency to ribbon-type electrical conductors 4 and 5 projecting laterally from the edge of the outer envelope 3. The conductors 4 and 5 are preferably formed of relatively fine mesh wire cloth, for example, 200–300 mesh, of suitable electrically conductive material such as copper or phosphor bronze, the ribbon conductors being connected to respective ones of the lamp electrodes. The outer envelope 3 is composed of sheets 6 and 7 of suitable organic material which seals together under heat and pressure. Sheets 6 and 7 overreach the marginal edges of the electrically active cell portion 2 and are sealed together along their margins so as to completely enclose the cell portion 2. The materials selected for the encapsulating envelope 3 are preferably tough and stable in addition to exhibiting light-transmitting qualities and high impermeability to moisture, and further they are preferably flexible in nature. Among the materials which may be satisfactorily employed for this purpose are polyethylene, polytetrafluorethylene, polychlorotrifluorethylene, polystyrene, methyl methacrylate, polyvinylidine chloride, polyvinyl chloride, polycarbonate materials such as, for example, the reaction products of diphenylcarbonate and Bisphenol A and polyethylene terephthalate. The materials preferably employed for such purpose, however, consist either of polychlorotrifluoroethylene film, known as Kel F, of approximately 0.005 inch thickness, or of resin-impregnated mica mat such as that disclosed and claimed in copending U.S. application Ser. No. 118,113, Levetan, filed June 19, 1961, and since abandoned.

The electrically active inner portion or assembly 2 of the electroluminescent cell or lamp 1, i.e., the light-producing components thereof, is constituted by a flexible panel assembly essentially comprised of a phosphor layer 8 sandwiched between a pair of electrode layers 9 and 10 at least one of which, e.g., the front electrode 10, is of a light-transmitting character having a transmittance of at least 60%, and can be of the type described in the aforementioned U.S. Pat. No. 3,315,111. Except for the front electrode component 10 thereof, the electrically active cell portion 2 may consist of any of the known types of flexible electroluminescent cell assemblies which are of non-fragile character and light in weight. Preferably, however, it is of the general form disclosed and claimed in U.S. Pat. No. 2,945,976, Fridrich et al, dated July 19, 1960, and comprising a rectangular sheet of a thin metal foil 9, for instance full-soft aluminum, of around 0.0022 inch thickness, coated with a thin insulating or barrier layer 11 of high dielectric constant material which is overcoated with a thin light-producing layer 8 of an electroluminescent phosphor dispersed in a dielectric material. The aluminum foil sheet 9 constitutes the back electrode layer of the lamp and is placed over the lowermost sheet member 6 of the encapsulating envelope 3 leaving a clear margin all around, as shown in said accompanying drawing. The insulating or barrier layer 11, which suitably may be of a thickness of, for example, around 1 mil or so, may consist of barium titanate dispersed in an organic polymeric matrix of high dielectric constant such as cyanoethyl cellulose plasticized with cyanoethyl phthalate as described and claimed in U.S. Pat. No. 2,951,865, Jaffe et al, issued Sept. 6, 1960, and in U.S. application Ser. No. 701,907, Jaffe, filed Dec. 10, 1957, now U.S. Pat. No. 3,238,407, and assigned to the same assignee as the present invention. Other suitable organic polymeric matrix materials for the barium titanate insulating layer 11 are cellulose nitrate, cyanoethyl starch, polyacrylates, methacrylates, polyvinyl chloride, cellulose acetate, alkyd resins, epoxy cements, and polymers of triallyl cyanurate, to which may be added modifying substances or plasticizers such as camphor, dioctyl phthalate, tricresyl phosphate and similar materials.

The electroluminescent phosphor layer 8, which likewise may be suitable of a thickness of, for example, around 1 mil or so, includes the phosphor admixtures of the present invention. For example, said phosphor layer can be deposited from an organic liquid suspension containing in proportions by weight approximately 60 parts phosphor, 20 parts additive, 19 parts $\alpha$-cyanoethylphthalate plasticizer, and 21 parts cyanoethylcellulose binder which is deposited as a thin film on the insulating barrier 11. A method of fabricating said overall electroluminescent cell or lamp construction is also described in detail in said aforementioned U.S. Pat. No. 3,315,111.

To more specifically disclose the extent of performance improvement obtained in accordance with the present phosphor admixtures, various electroluminescent cells or lamps having the above-described construction were produced for testing when operated at 120 volts and 400 Hertz input electrical power. The light output and current density measurements obtained on said test lamps are reported in the table below with said reported measurements representing the average results of 8 or more lamps tested with each phosphor admixture.

| Additive | Brightness (Foot-Lamberts) | Current Density (milliamperes/in$^2$) |
|---|---|---|
| None | 28.4 | 3.7 |
| Zinc Sulfide (unactivated) | 25.9 | 2.6 |
| Silica | 21.9 | 2.4 |
| Alumina | 24.0 | 3.0 |

It can be noted that the above test results that a lower current density in lamp operation is achieved with each of the reported additives with varying amounts of brightness loss up to approximately 23%. A further optimization of the particle size and size distribution for the additive component in the present phosphor admixtures may significantly lessen the above indicated brightness loss for said admixtures. None of the test lamps utilizing said phosphor admixtures experienced any arc-out condition during operation.

It will be apparent from said foregoing description that a simple and effective means has been discovered to improve the operation and performance of flexible type of electroluminescent devices. It will also be apparent, however, that phosphor admixtures other than above specifically disclosed can be utilized to provide comparable improvement. For example, still other additives in the form of unactivated, inorganic phosphor crystalline materials are contemplated for combination in this manner with phosphors of the same or dissimilar chemical composition so long as similar optical and size considerations apply. It is intended to limit the present invention, therefore, only by the scope of the following claims.

What we claim as new and desire to secure by Letters Patent of the United States is:

1. In a flexible electroluminescent lamp construction having an electroluminescent cell in the form of an electroluminescent phosphor layer sandwiched between a pair of electrically conductive layers at least one of which is light-transmitting, the improvement wherein said electroluminescent phosphor layer comprises an admixture of electroluminescent phosphor particles with unactivated phosphor particles of the same composition in an amount which reduces the initial current density of said electroluminescent cell.

2. An electroluminescent lamp as in claim 1 wherein said phosphor admixture comprises copper-activated zinc sulfide admixed with unactivated zinc sulfide.

3. An electroluminescent lamp as in claim 1 wherein said admixture comprises in parts by weight about 60 parts to about 90 parts of said electroluminescent phosphor particles admixed with about 40 parts to about 10 parts of said unactivated phosphor particles of the same composition.

4. An electroluminescent lamp as in claim 3 wherein said admixture comprises in parts by weight about 60 parts to about 90 parts copper-activated zinc sulfide admixed with about 40 parts to about 10 parts unactivated zinc sulfide.

* * * * *